United States Patent [19]

Fresard et al.

[11] 4,161,151

[45] Jul. 17, 1979

[54] SEWING MACHINE

[75] Inventors: Marcel Fresard, Petit-Lancy; Antonio Jimenez, Meyrin, both of Switzerland

[73] Assignee: Mefina S.A., Fribourg, Switzerland

[21] Appl. No.: 872,034

[22] Filed: Jan. 25, 1978

[30] Foreign Application Priority Data

Feb. 8, 1977 [CH] Switzerland ..... 1475/77
Sep. 1, 1977 [CH] Switzerland ..... 10662/77

[51] Int. Cl.[2] ..... D05B 73/10
[52] U.S. Cl. ..... 112/217.1; 312/29
[58] Field of Search ..... 112/217.1, 260; 312/26, 312/27, 28, 29

[56] References Cited

U.S. PATENT DOCUMENTS

| | | | |
|---|---|---|---|
| Re. 28,835 | 6/1976 | Roberts et al. | 312/29 |
| 2,486,564 | 11/1949 | Kamin | 312/29 |
| 3,468,589 | 9/1969 | Maynard | 312/29 |

FOREIGN PATENT DOCUMENTS

| | | | |
|---|---|---|---|
| 634940 | 1/1962 | Canada | 312/27 |
| 996402 | 8/1951 | France | 112/217.1 |
| 364263 | 10/1938 | Italy | 312/29 |

*Primary Examiner*—Henry Jaudon
*Attorney, Agent, or Firm*—Emory L. Groff, Jr.

[57] ABSTRACT

A sewing machine adapted to be mounted in a support member, comprising a column mounted on a lower frame member having a free arm portion extending therefrom, said column carrying an upper arm disposed generally parallel to the free arm portion and terminating in a head in which a drive mechanism of a needle carrying bar is provided, said lower frame member being pivotally connected to a casing by means of at least two support members pivoted at one of their ends to the frame member and pivoted at their other ends to the casing, characterized in that said support members connect said lower frame member to said casing in such a manner as to permit displacement of the machine with respect to the casing between a first position in which the lower framework member and the free arm are housed in said casing, with their upper faces being generally at the level of the upper edge of the casing, and a second position in which the free arm is on the elevated position above the casing.

6 Claims, 10 Drawing Figures

SEWING MACHINE

The present invention relates to a sewing machine adapted to be mounted in a support member such as the top of a table, a sewing machine furniture case or the base of a carrying case.

According to the present invention there is provided a sewing machine adapted to be mounted in a support member, comprising a column mounted on a lower framework member having a free arm extension, said column carrying an upper arm disposed parallel to the free arm and terminating in a head in which the drive mechanism of a needle carrying bar is provided said lower framework member being pivoted at one of the ends of at least two support members whose other ends are pivoted to a casing, characterized in that the said support members connect the lower framework member to the casing in a manner such as to permit displacement of the machine with respect to the casing between a first position in which the lower framework member and the free arm are housed in the casing with their upper faces being generally at the level of the upper edge of the casing and a second position in which the free arm is in the elevated position above the casing.

The invention will be described further by way of example with reference to the accompanying drawings, in which.

Figure 1:
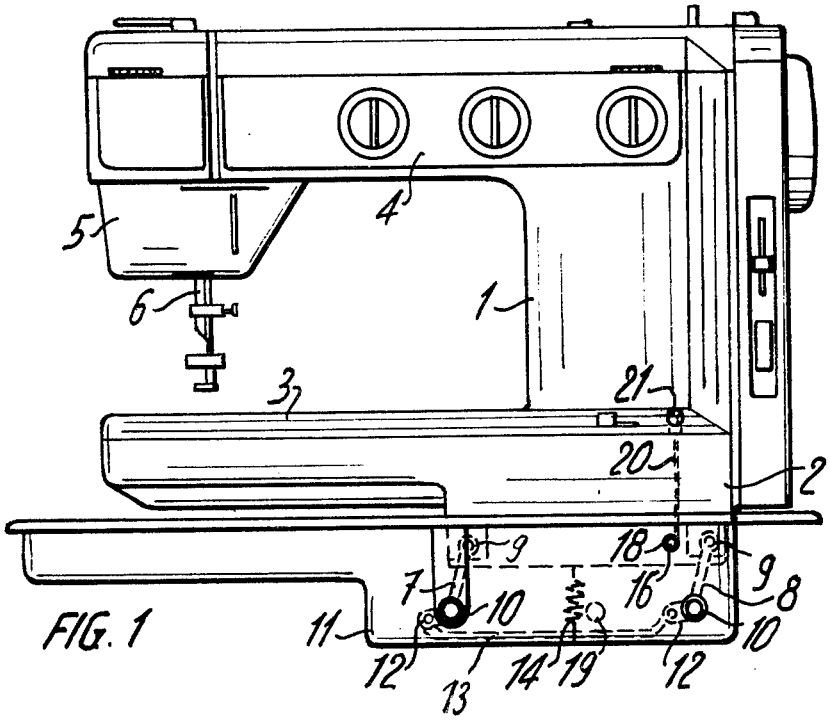
FIG. 1 is a front elevation of a first embodiment of the invention showing the machine in a free arm disengaged position.

A sewing machine is represented in FIGS. 1 to 7 and comprises a column 1 mounted on a lower framework member 2 which is extended by a free arm 3. The column 1 carries an upper arm 4 disposed parallel to the free arm 3 and terminating in a head 5 in which the drive mechanism of a needle carrying bar 6 is housed.

Small connecting rods or links 7, 8 are pivoted in pairs at their ends 9 to the front and rear faces of the lower framework member 2 and pivoted by their other ends 10 to the inside of a casing 11 in which the lower framework member 2 is at least partially engaged.

The links 7, 8 pivoted inside the casing 11 have an extension 12 leading from their pivotal ends 10 to the casing 11. These extensions 12 of the links 7 and 8 are themselves pivoted to the ends of a connecting rod 13. This ensures the maintenance of parallel movement of two pairs of links during the manual displacement of the machine from its position shown in FIG. 2, in which the lower framework member 2 and the free arm 3 are housed in the casing 11, to the position represented in FIG. 1, in which the free arm 3 is in the disengaged position above the casing 11.

Figure 3:
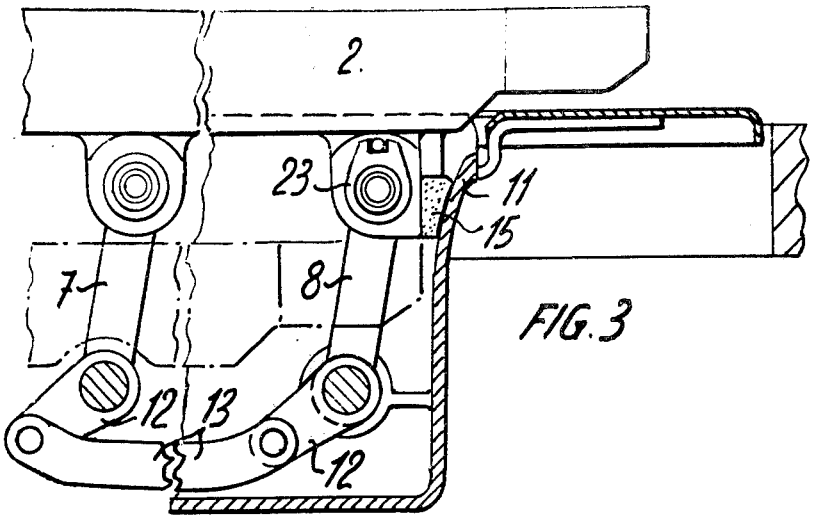
FIG. 3 is a partial sectional view, similar to FIG. 2 but on an enlarged scale and representing the support members in the free arm disengaged position.
Figure 4:
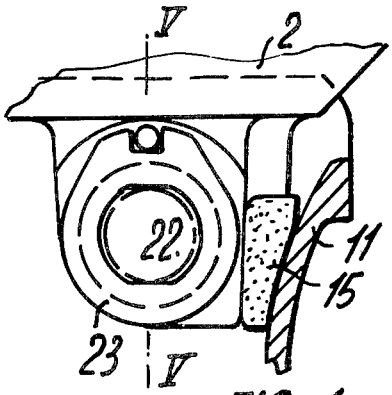
FIG. 4 is an enlarged partial view of the support member represented in FIG. 3.

A spring 14 is mounted between the lower surface of the lower framework 2 and the base of the casing 11 and also contributes to the stabilisation of the machine in its above mentioned positions of use. As shown in FIGS. 3 and 4, the lower framework 2 also bears against the internal surface of of the wall of the casing 11 in this position with the interposition of an abutment 15 of supple material.

Figure 2:
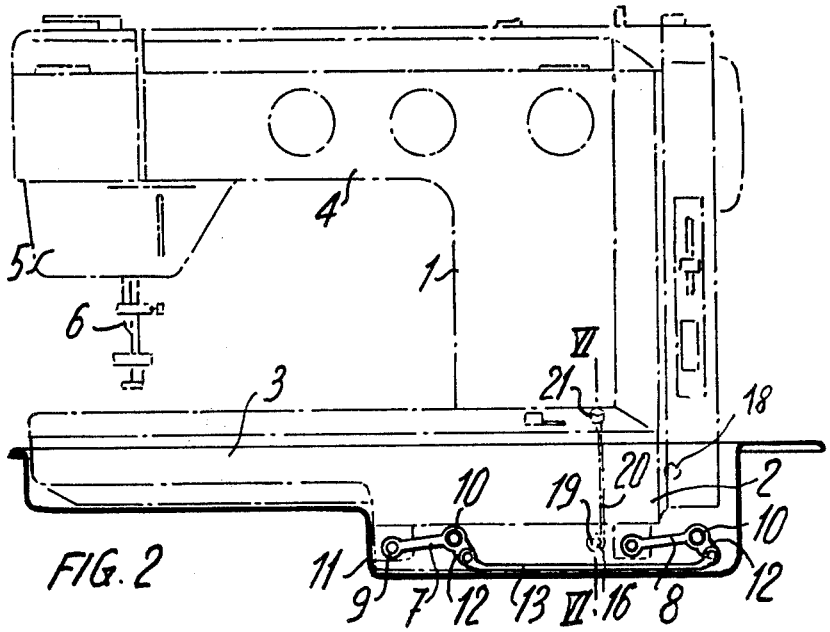
FIG. 2 is a partial longitudinal section of the machine in the same position on a plane base and showing support members.
Figure 7:
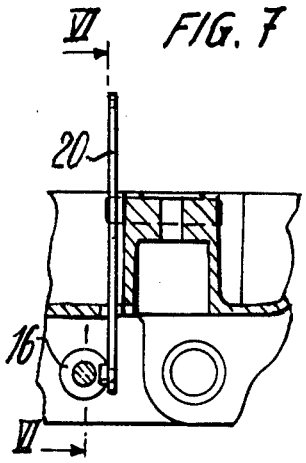
FIG. 7 is a section taken along the line VII—VII of FIG. 6.
Figure 6:
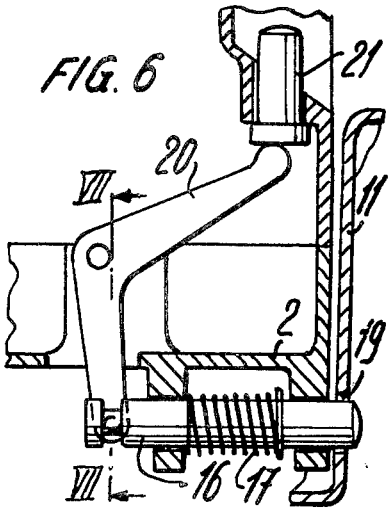
FIG. 6 is a section taken along the line VI—VI of FIG. 2 and representing the bolting device in the sewing position on a plane base.

A bolting mechanism for the machine in the position represented in FIG. 1 and in the position represented in FIG. 2 is equally conceived. It consists in a peg or pin 16 slidably mounted in the arm of the lower framework 2 and biassed by a spring 17 to ensure the engagement of one of its ends in a slot provided in the wall of the casing 11. A first slot 18 permits engagement of the pin 16 in the position represented in FIG. 1 and a second slot 19 permits engagement in the position represented in FIG. 2. As represented in FIGS. 6 and 7, a lever 20 operable by a button 21 enables unbolting of the locking mechanism to permit the displacement of the machine from one of its positions to the other.

Figure 5:
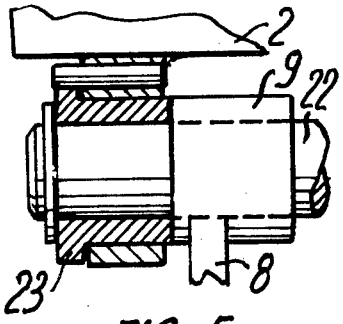
FIG. 5 is a section taken along the line V—V of FIG. 4.

So as to compensate for manufacturing tolerances in the assembly of pairs of links 7, 8 from their pivotal axis with the connecting rod 13; the pivotal axis 22 of the end 9 of one of the links 8 is located a journal which is provided with a bearing 23 of non-circular transverse section (see FIGS. 4 and 5).

It is to be noted that the casing 11 generally corresponds to the shape of the lower framework 2 and the free arm 3 of the machine in the position of such represented in FIG. 2. When the machine is bolted in this position, the upper surface of the free arm 3 and of the lower framework 2 are generally at the level of the upper edge of the casing 11. The upper edge of the casing 11 is provided with a peripheral border around its upper edge and whose dimensions correspond to that of the standard opening normally made in the tops of tables of furniture articles and of the bases of carrying cases of sewing machines. It is thus possible without other means to mount a machine described with any one of the three above mentioned support members and to possibly withdraw it from the table top or from the article of furniture to mount it in the base of a carrying case, for example.

Numerous variations of embodiments of machine described and illustrated in the drawings can be envisaged.

One could, for example, substitute two pivotal plates for the pairs of links 7, 8 inter-connecting the base of the case 11 and the inner surface of the lower framework 2.

In addition to the two bolting positions represented in the drawing, one might also provide at least one intermediate securing position by making, for example, a supplementary slot in the wall of the casing 11.

Figure 10:
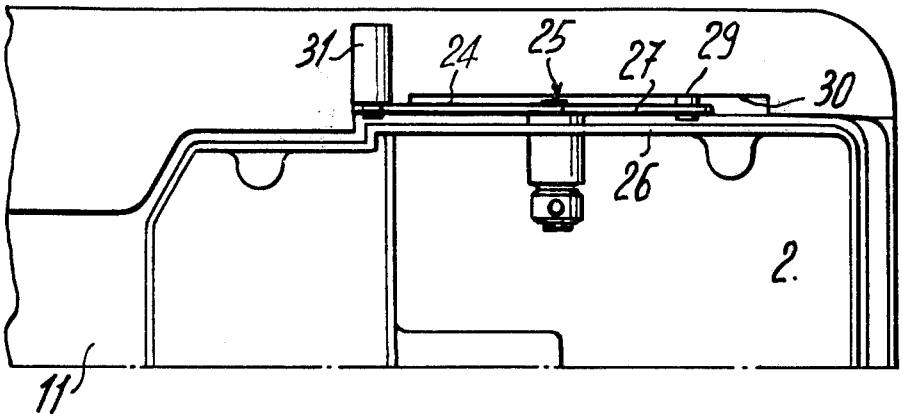
FIG. 10 is a partial horizontal section on an enlarged scale of the lower framework of the machine in the sewing position and on a plane base.

In order to facilitate displacement of the machine with respect to the casing in bringing it from one of the said positions to the other, the lever 24 is provided (see FIG. 10) which permits displacement of the machine with respect to the casing 11; lever 24 being mounted on a pivot 25 projecting from a longitudinal wall 26 of the lower framework member 2. One of the arms 27 of this lever 24 presents a free forked end 28 by means of which it is pivoted to a pivot pin 29 projecting from the inner face 30 of the casing 11 which is opposite the wall 26 of the lower framework member 2. The other arm of the lever 24 is provided at its free end with an operating handle 31 (see FIG. 10).

Figure 8:
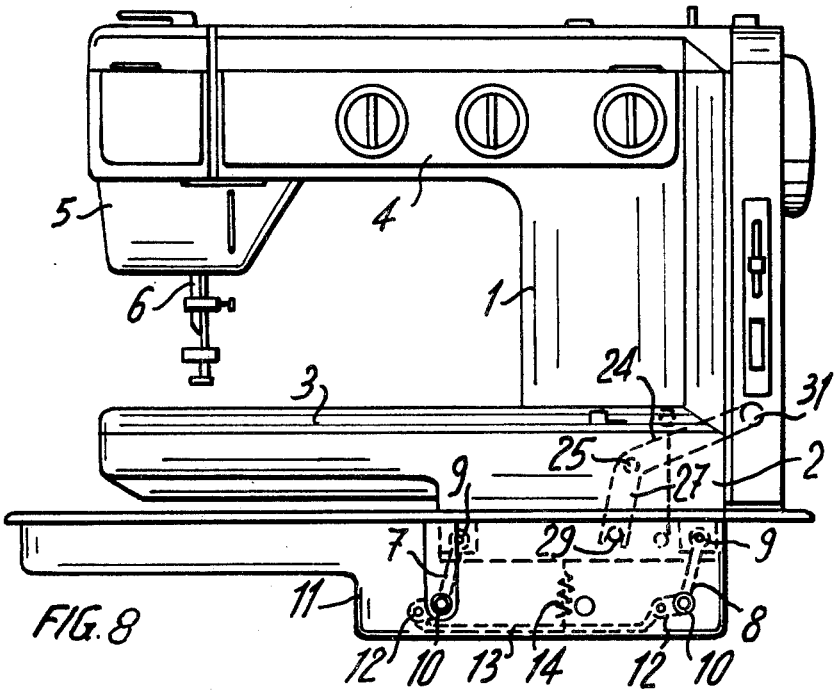
FIG. 8 is a view similar to FIG. 1 of a second embodiment of the invention.
Figure 9:
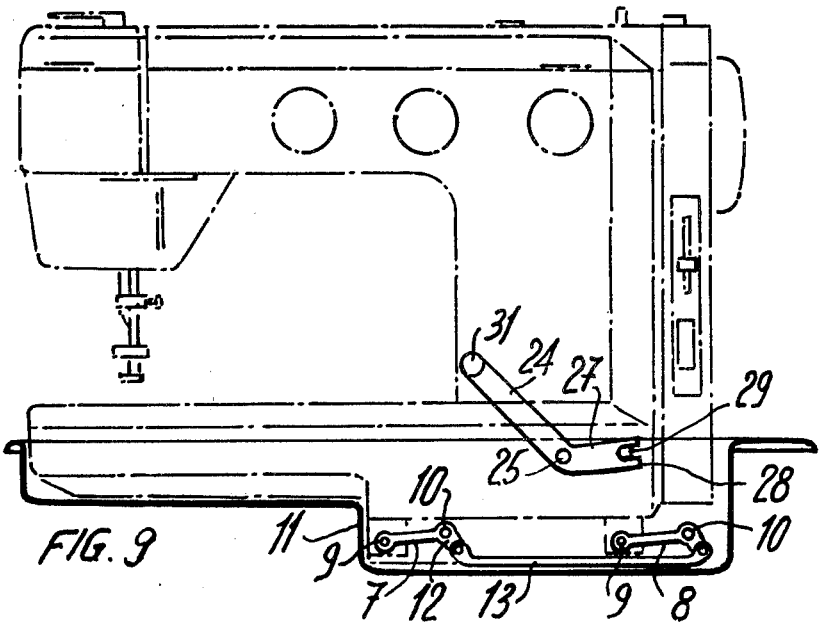
FIG. 9 is a view similar to FIG. 2 representing the lever for controlling displacement of the machine in the sewing position on a plane base.

The pivots 25 and 29 are aligned parallel to the links 7 and 8 so that the arm 27 of the lever 24 pivots parallel to the links 7 and 8 when the machine is displaced from its position represented in FIG. 9 into its position represented in FIG. 8 and vice versa.

We claim:

1. In a sewing machine adapted to be mounted in a support member, comprising a column, a lower frame member on which said column is mounted, said lower frame member including a free arm portion extending therefrom, an upper arm on said column disposed generally parallel to said free arm portion and terminating in a head in which a drive mechanism of a needle carrying bar is provided, a casing, means pivotally connecting said lower frame member to said casing, said means comprising at least two support members pivoted at one of their ends to said frame member and pivoted at their other ends to said casing, the improvement wherein said support members connect said lower frame member to said casing in such a manner as to permit displacement of the machine with respect to the casing between a first position in which the lower framework member and the free arm are housed in said casing, with their upper faces being generally at the level of the upper edge of the casing, and a second position in which the free arm is on the elevated position above the casing, a connecting rod pivoted at its ends to two of said support members so as to ensure maintenance of their parallelism when the machine is displaced from its first position into its second position, said support members comprising links pivoted in pairs on two sides of said lower frame member and pivoted to the inside of said casing, at least one of each such pair of links provided with an extension at one of its pivotal ends and on which one of the ends of said connecting rod is pivoted thus connecting it to a link of the other pair, a bearing of non-circular transverse section on at least one end of said links to permit compensation for the manufacturing tolerances of the assembly of the pivots points of said links and of said connecting rods.

2. A sewing machine according to claim 1 wherein a device is provided for securing the lower frame member to the casing in at least one of the said positions.

3. A sewing machine according to claim 2, in which a spring is provided extending between the lower frame and casing and adapted to stabilize the machine in at least one of the said positions.

4. A sewing machine according to claim 3, wherein said casing generally corresponds to the form of the lower frame member and of said free arm in the said first position; the upper edge of said casing being provided with peripheral border rejoining the borders of an opening provided in the support member.

5. A sewing machine according to claim 4 wherein a lever is provided and adapted to displace the machine with respect to the casing and mounted on a pivot projecting from a longitudinal wall of said lower frame member; one of the arms of said lever being pivotally mounted at its free end on a pivot extending from an internal surface opposite said casing while the other arm of said lever is provided with an operating handle at its free end.

6. A sewing machine according to claim 5, wherein said pivot extending from the lateral wall of the lower frame member and the pivot projecting from the inner surface opposite the casing are disposed in such an alignment that the arms of the lever inter-connecting them are orientated parallel to the support members connecting the lower framework member to said casing.

* * * * *